US006009919A

United States Patent [19]

Rumbley, III

[11] Patent Number: 6,009,919

[45] Date of Patent: Jan. 4, 2000

[54] METHOD FOR CONVERTING A BALL AND SOCKET TO A DOWEL PIN JOINT ON A WATER JET LOOM AND PRODUCT PRODUCED THEREBY

[76] Inventor: Edward R Rumbley, III, 2528 Juniper Dr., NE., Roanoke, Va. 24555

[21] Appl. No.: 08/993,510

[22] Filed: Dec. 18, 1997

[51] Int. Cl.[7] ..... D03J 1/00

[52] U.S. Cl. ..... 139/435.1; 139/57; 403/163

[58] Field of Search ..... 139/435.1, 57; 403/43, 163

[56] References Cited

U.S. PATENT DOCUMENTS

| | | | |
|---|---|---|---|
| 1,562,268 | 11/1925 | Watson | 139/57 |
| 3,482,862 | 12/1969 | Maloney | 403/163 |
| 4,548,125 | 10/1985 | Huther | 403/163 |
| 4,607,965 | 8/1986 | Belanger . | |
| 4,730,645 | 3/1988 | Baird et al. | 139/435.1 |
| 5,174,633 | 12/1992 | Kidd et al. . | |
| 5,348,054 | 9/1994 | Oertli | 139/57 |
| 5,447,181 | 9/1995 | Tahara et al. . | |
| 5,740,840 | 4/1998 | Lindahl | 139/57 |

*Primary Examiner*—Andy Falik
*Attorney, Agent, or Firm*—Donavon Lee Favre

[57] ABSTRACT

A metal socket in a reciprocating foot mates with a ball on the lower end of a heddle frame driving rod of a conventional NISSAN water jet loom. Water causes corrosion in the ball and socket joint resulting in down time of the water jet loom. The replacement of the metal ball and socket joint with a joint comprising a plastic bearing and a dowel pin reduces the down time of the loom caused by the corrosion of the ball and socket joint.

7 Claims, 8 Drawing Sheets

METHOD FOR CONVERTING A BALL AND SOCKET TO A DOWEL PIN JOINT ON A WATER JET LOOM AND PRODUCT PRODUCED THEREBY

CROSS REFERENCE TO RELATED APPLICATIONS

Not Applicable

FEDERALLY SPONSORED RESEARCH

Not Applicable

BACKGROUND OF THE INVENTION

The water jet loom overcomes many of the difficulties of the mechanical shuttle used to carry a weft back and forth in a loom. The water jet devices are easily controlled, have few moving parts and therefore fewer mechanical breakdowns, and can be made to operated significantly faster than mechanical weft control devices. However, when there is a mechanical breakdown, significant production is lost because of the high production rates of the water jet looms. One of the problems causing mechanical breakdown is corrosion caused by the presence of water in the atmosphere surrounding the loom. One of the major causes of downtime in at least one model of the Nissan water jet loom is caused by corrosion in a ball and socket mounted in a foot used to move rods.

U.S. Pat. No. 5,447,181 Tahara et al (1995) at col. 1, lines 62 to 68 discloses "Namely, the surface of a guide bar blade in this invention is nitrided for hardening. For this reason the blade surface becomes harder than that heretofore in use, which results in the wear resistance for high-speed operation of an automatic loom and also prevents the surface from rusting.

U.S. Pat. No. 4,607,965 Belanger (1986) discloses and improved bearing for supporting a bifold door. The bearing is described at col. 5, lines 36 to 47 as follows:

"The bearing members 18, may be constructed from various plastic materials including high or ultra high molecular weight polymers sold under the trademark GARDUR by Garland Manufacturing Company—, nylon and high density polyethylene resins having selected characteristics such as being abrasion resistant, stable in shape, high in lubricity or self lubricating, tensile strength, rigid, high fatigue life and creep resistant and unaffected by industrial chemicals and solvents—. Such plastics include Delrin®, Oilon® and Lauramid™ brand cast nylon made in West Germany."

U.S. Pat. No. 5,174,633 Kidd et al (1992) at col. 2, lines 49 through 53 discloses:

"The annular bearings 13 and 14 are preferably made of a moldable synthetic resin material in the nature of a conventional hard plastic or a similar material, for example and acetal resin material commercially available from DuPont under the trademark DELRIN."

BRIEF SUMMARY OF THE INVENTION

I have unexpectedly discovered that the down time of a water jet loom having a ball and socket joint made of metal exposed to an atmosphere containing liquid water droplets can be significantly reduced by replacing the ball and socket joint with a corrosion resistant dowel pin in a plastic bearing. The plastic bearing not only resist corrosion but also acts as a cushion block reducing wear caused by impact. Preferably the plastic bearing is high density polyethylene and the corrosion resistant dowel pin is cold rolled steel. The ball and socket joint, prior to replacement, is mounted in a reciprocating lever arm attached to a shaft. One or more rods extend from the ball and socket joint and the bearing which replaces the ball and socket joint.

DETAILED DESCRIPTION OF THE INVENTION

Figure 1:
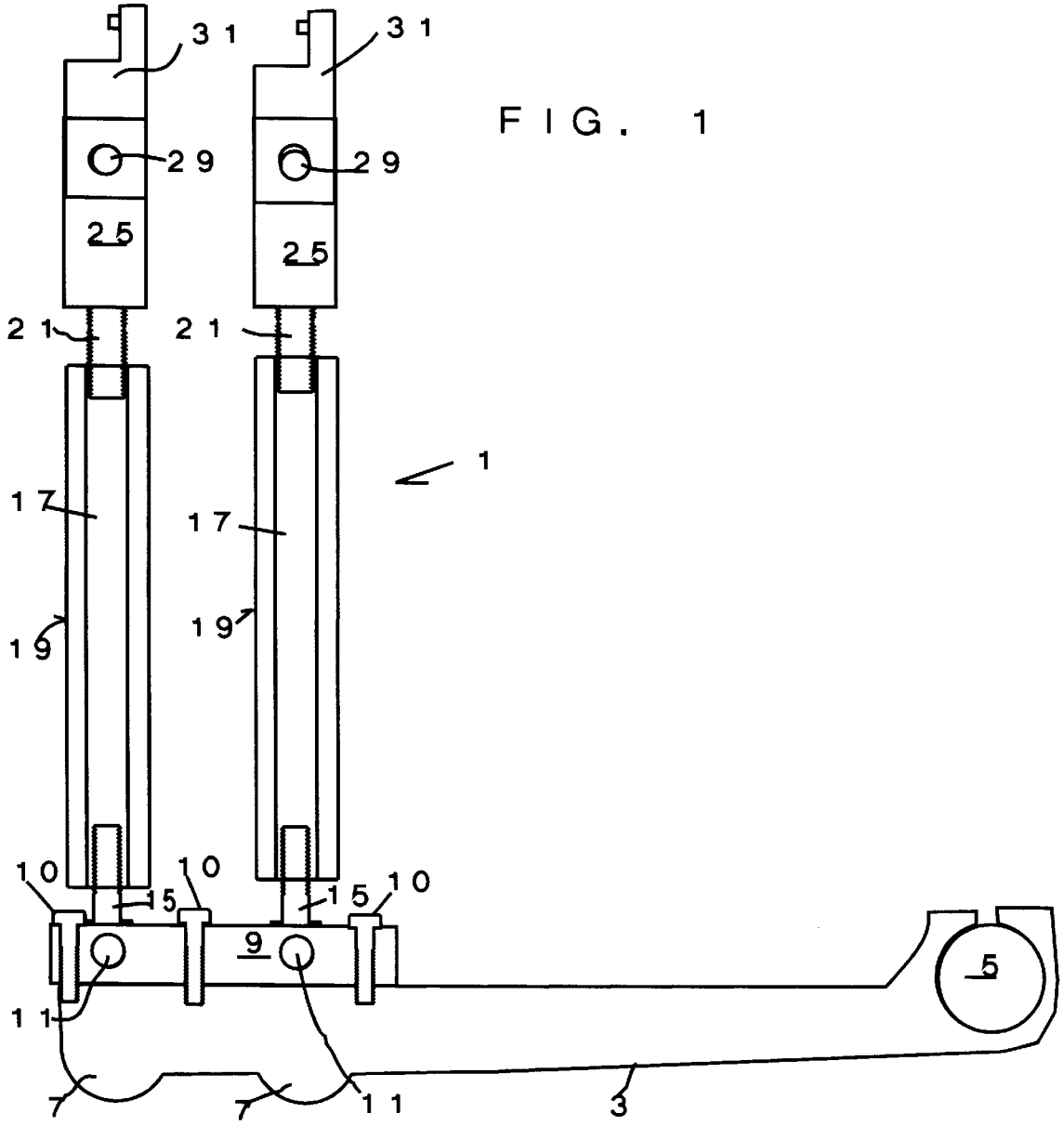
FIG. 1 shows, partially in section, the plastic bearings of the present invention replacing the ball and socket and the upper bearing of the prior art in a mechanism for moving the harness frame of a NISSAN water jet loom.
Figure 2:
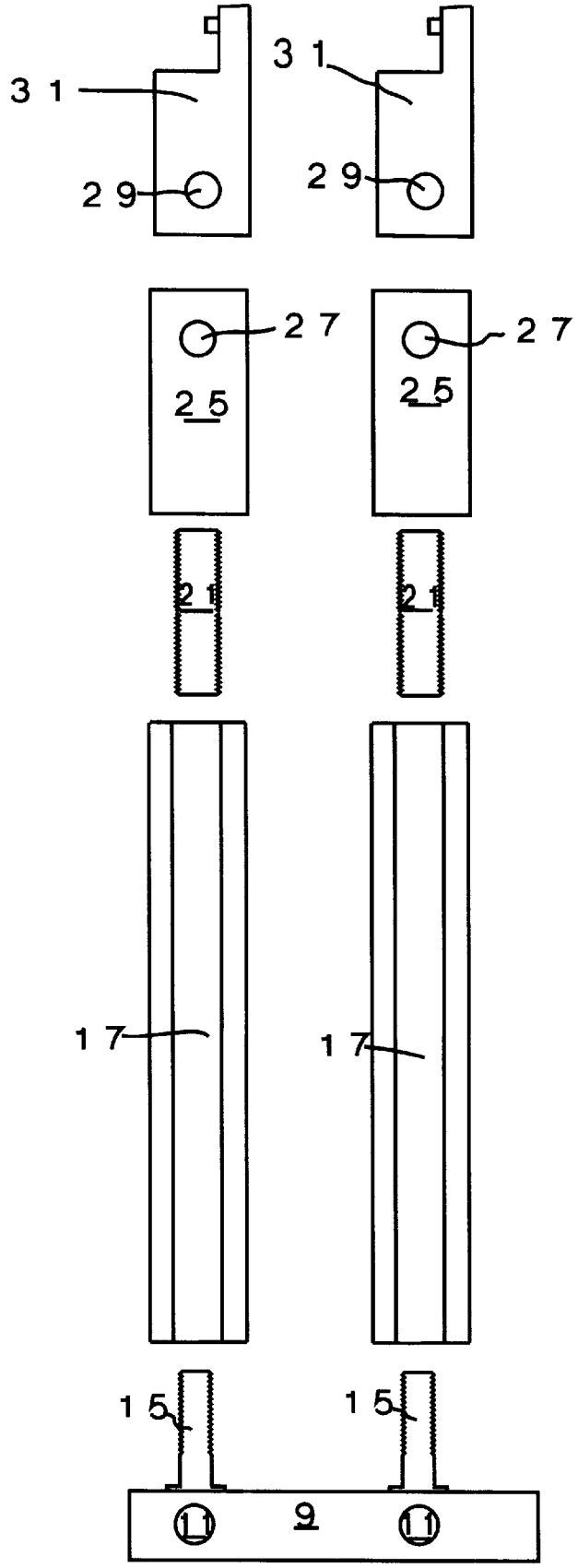
FIG. 2 is an exploded view of the bearing and turnbuckle components of FIG. 1
Figure 3:
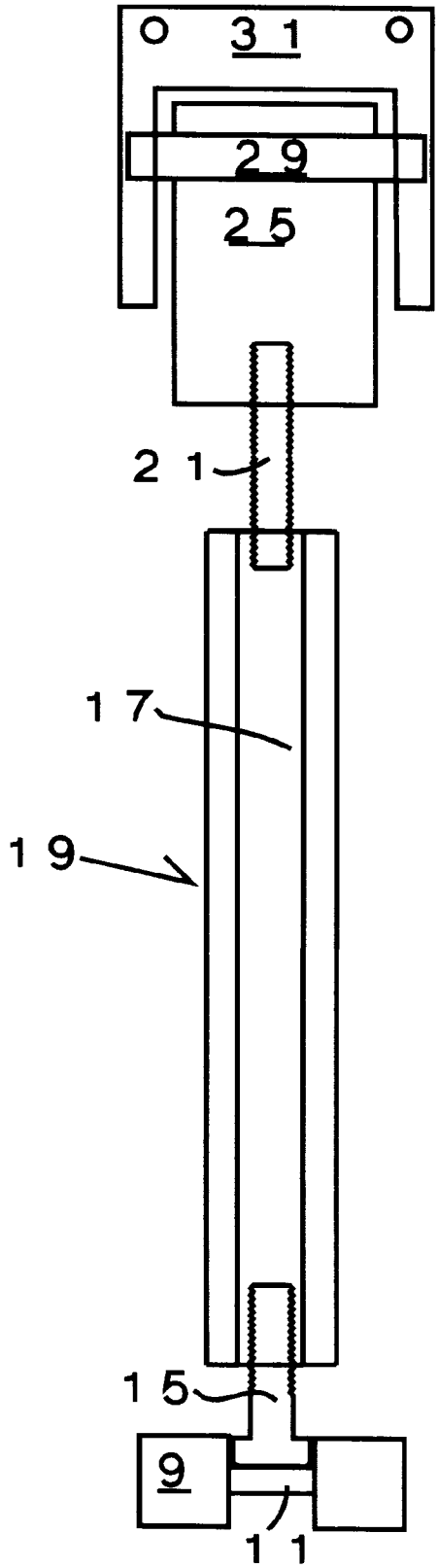
FIG. 3 is a right side view of the heddle frame bearing, turnbuckle and joint of FIG. 9.
Figure 4:
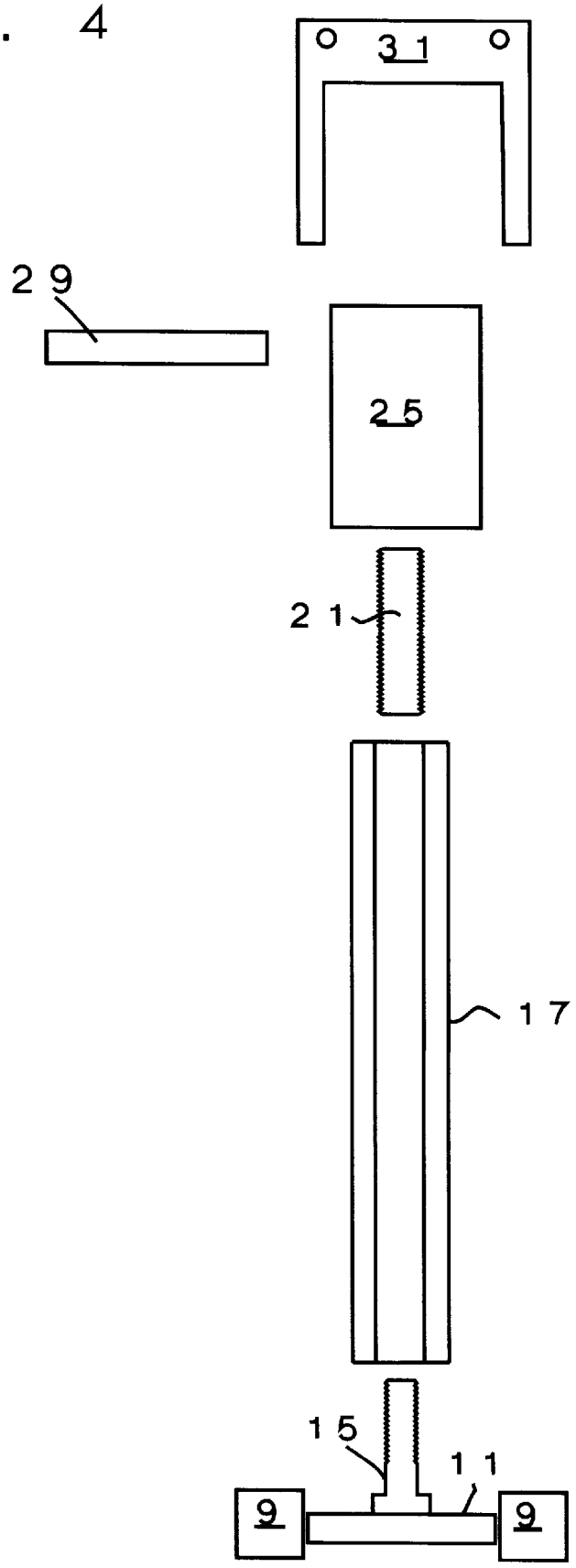
FIG. 4 is an exploded view of FIG. 3 showing the individual components of FIG. 3.
Figure 5:
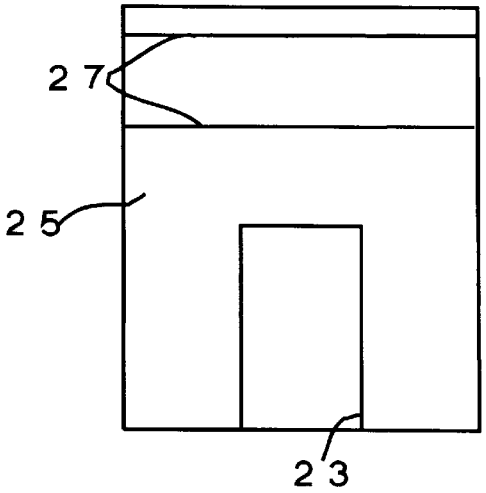
FIG. 5 is an end view, partially in section, of the upper plastic bearing of the present invention.
Figure 6:
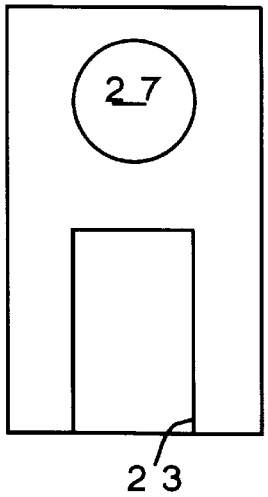
FIG. 6 is a side view of the bearing of FIG. 5.
Figure 7:
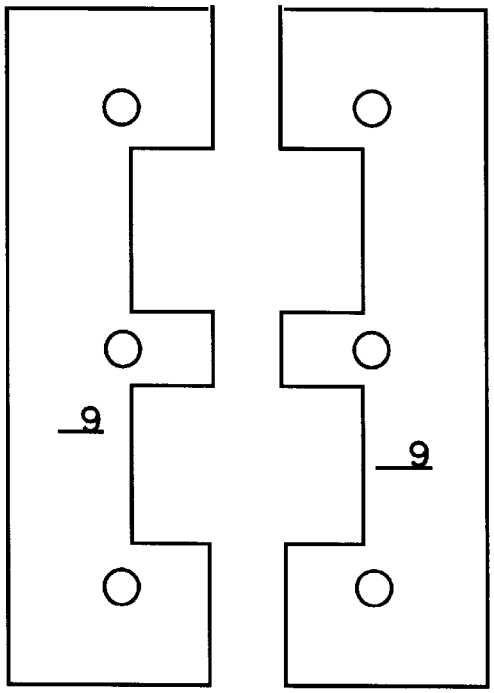
FIG. 7 is a top view of the two halves of the lower bearing.
Figure 8:
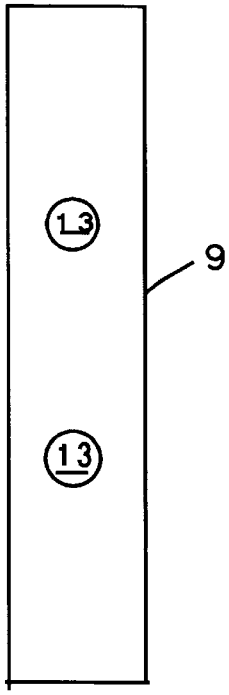
FIG. 8 is a side view of the bearing of FIG. 7.
Figure 9:
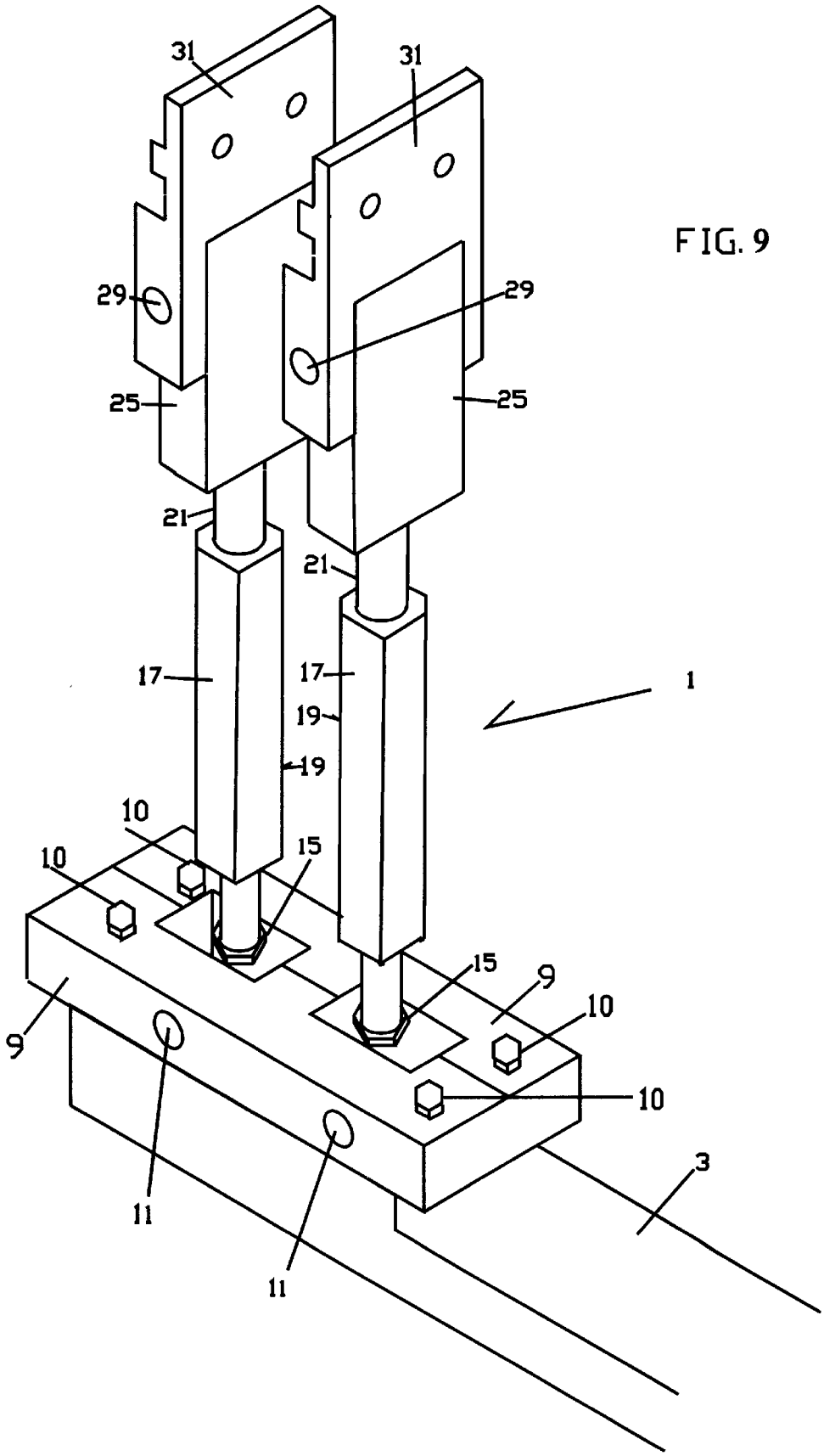
FIG. 9 is an isometric view of a heddle frame reciprocating mechanism showing the dowel pin joint in a plastic bearing of the present invention.

Turning now to FIG. 1, there is shown the rod and bearing assembly 1 of the present invention, driven in a reciprocating motion by lever arm 3 attached to shaft 5. The balls previously mounted in sockets 7 to drive rods, of the previous assembly, have been replaced by a bearing block or bushing 9 made of high density polyethylene. Bearing block 9 is fastened to lever arm 3 or reciprocating foot by bolts 10 which extend through bearing block 9 into threads in lever arm 3. As is shown in FIG. 2, dowel pins 11 (see FIG. 4) are pivotably mounted in mating cylindrical openings 13 (see FIG. 8) of bearing 9. Dowel pins 11 are made of cold rolled steel and are welded to the heads of bolts 15. Bolts 15 are threaded into the bottom ends of internally threaded reciprocating heddle frame drive or shedding rods 17 to form turnbuckles 19. The upper ends of shedding rods 17 are internally threaded to receive the lower end of threaded shaft 21 to complete turnbuckle 19. The upper end of threaded shaft 21 is threaded into internally threaded opening 23 (see FIG. 5) of the lower part 25 of the upper shedding rod joint. Cylindrical opening 27 through the lower part 25 of the upper shedding rod joint forms a bearing support for dowel pin 29. The upper part 31 of the upper shedding rod joint is pivotably mounted to lower part 25 of the upper shedding rod joint by dowel pin 29. The upper part 31 of the upper shedding rod joint is bolted to a heddle frame of a conventional NISSAN water jet loom (not shown).

In November of 1996, light ball and socket assemblies on one NISSAN water jet loom, were replaced with eight rod and bearing assemblies 1 of the present invention. The result of the experiment was that the down time of the NISSAN water jet loom caused by failure of the shedding rod joints was eliminated by the substitution as of the date of filing this application. Subsequently the ball and socket assemblies of 170 NISSAN water jet looms were replaced by the rod and bearing assemblies of the present invention significantly improving production by eliminating down time caused by failure of the shedding rod joints.

The turnbuckle 19 allows the rod and bearing assemblies 1 to be used on different models of the NISSAN water jet loom which require different rod lengths.

Figure 10:
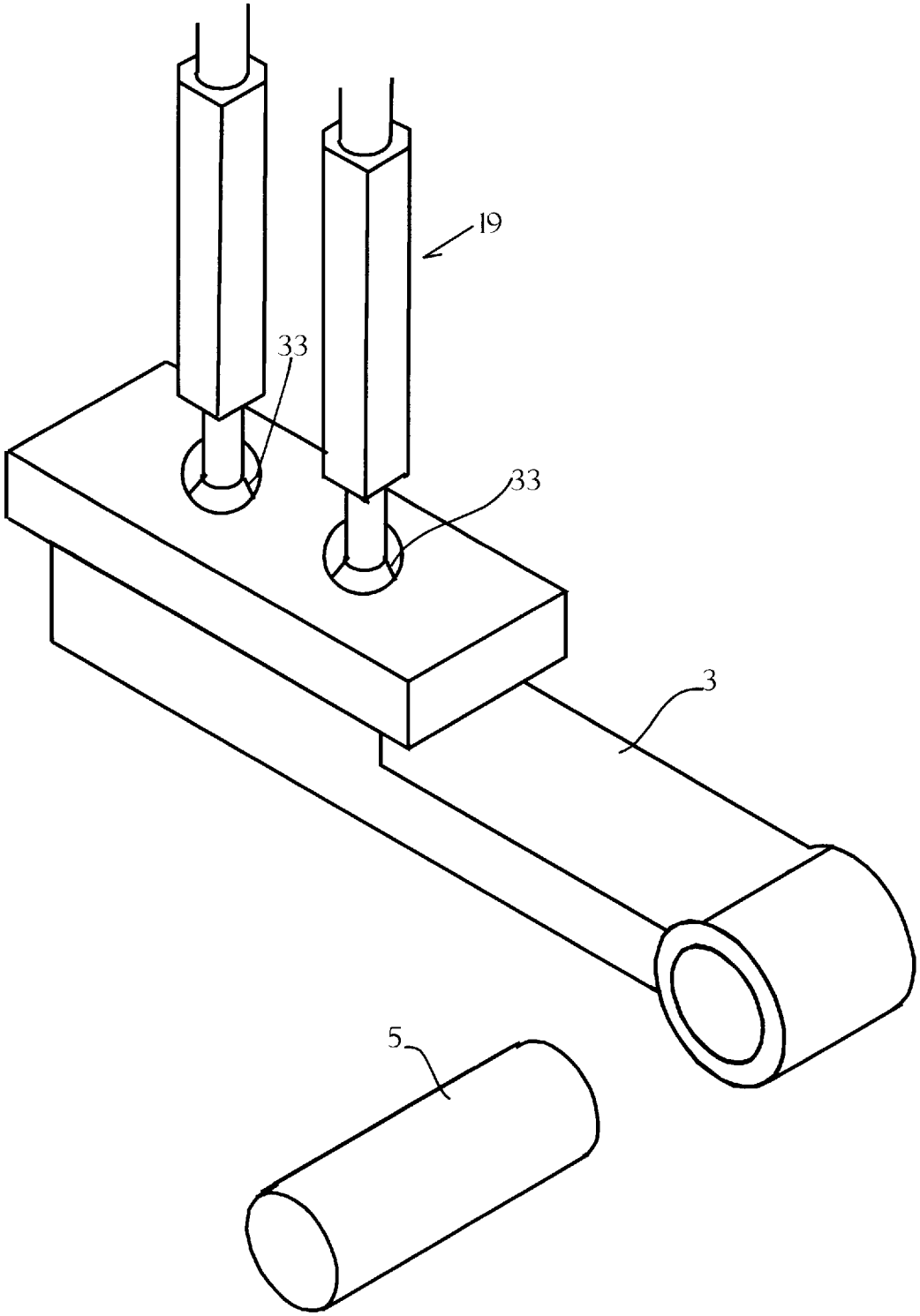
FIG. 10 PRIOR ART
FIG. 10 shows the prior art heddle frame reciprocating mechanism.
Figure 11:
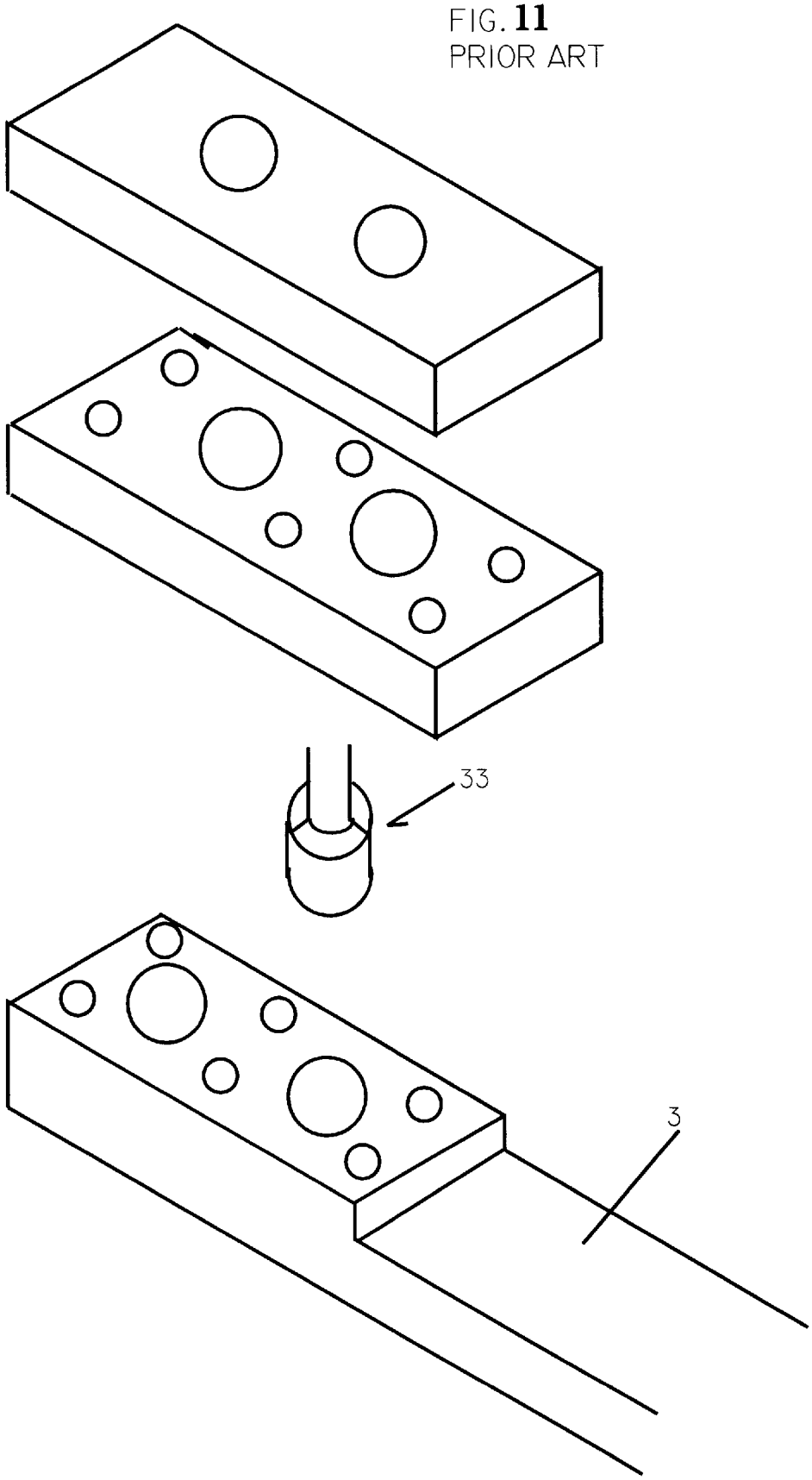
FIG. 11 PRIOR ART
FIG. 11 is an exploded view of FIG. 10.

The prior art is shown in FIGS. 10 and 11. There is shown a metal ball and socket assembly 33, which failed in normal operation, and has been replaced by the plastic bearing block 9 and dowel pins 11 of the present invention.

I claim:

1. A method of reducing the down time of a water jet loom having a ball and socket joint exposed to water, and mounted in a reciprocating lever arm, the lever arm attached to a reciprocating shaft, the ball and socket joint being positioned between the lever arm and a reciprocating rod, said method comprising replacing the ball and socket joint with a dowel pin in a plastic bearing the dowel pin having a threaded shaft extending at a right angle therefrom for connection to the rod.

2. The method of claim 1 comprising using high density polyethylene as the plastic bearing.

3. The method of claim 2 comprising using cold rolled steel as the material for the dowel pin.

4. The method of claim 3 comprising replacing the ball and socket joint mounted in the reciprocating lever arm attached to the shaft which ball and socket joint joins the lever arm to the reciprocating rod which rod in turn moves a heddle frame.

5. The method of claim comprising using one or more rods extending from each dowel pin in each of a plurality of plastic bearings mounted on a single reciprocating lever arm.

6. A kit for modifying a water jet loom having a metal ball and socket joint joining a reciprocating foot and a reciprocating heddle frame drive rod, wherein the kit comprises:

a) a plastic bushing adapted to be bolted to the foot to replace the metal ball, and b) a dowel pin to be inserted into the plastic bushing, the dowel pin having a threaded shaft extending a right angles from the dowel pin for connection to the heddle frame drive rod.

7. In a water jet loom having a heddle frame driven by a reciprocating rod driven by a reciprocating foot, the improvement comprising;

a) a plastic bearing mounted on the reciprocating foot, b) a metal dowel positioned in the plastic bearing, and c) a threaded shaft extending at a right angle from the dowel, the threaded shaft being threaded into the reciprocating rod, whereby motion is transmitted from the foot, through the rod and to the heddle frame.

* * * * *